US009472329B2

(12) United States Patent
Carsten

(10) Patent No.: US 9,472,329 B2
(45) Date of Patent: Oct. 18, 2016

(54) HIGH LEAKAGE TRANSFORMERS WITH TAPE WOUND CORES

(76) Inventor: Bruce W. Carsten, Corvallis, OR (US)

( * ) Notice: Subject to any disclaimer, the term of this patent is extended or adjusted under 35 U.S.C. 154(b) by 0 days.

(21) Appl. No.: 13/586,567

(22) Filed: Aug. 15, 2012

(65) Prior Publication Data

US 2014/0049351 A1 Feb. 20, 2014

(51) Int. Cl.

| | |
|---|---|
| ***H01F 21/08*** | (2006.01) |
| ***H01F 17/06*** | (2006.01) |
| ***H01F 27/24*** | (2006.01) |
| ***H01F 3/12*** | (2006.01) |

(52) U.S. Cl.
CPC ..... *H01F 3/12* (2013.01)

(58) Field of Classification Search
USPC ..... 336/160, 165, 178, 182, 211–214, 220, 336/221
See application file for complete search history.

(56) References Cited

U.S. PATENT DOCUMENTS

| | | | | | |
|---|---|---|---|---|---|
| 2,344,294 | A | * | 3/1944 | Evans | 336/5 |
| 2,488,391 | A | * | 11/1949 | Ford et al. | 336/210 |
| 2,908,880 | A | * | 10/1959 | Steinmayer et al. | 336/213 |
| 2,946,028 | A | * | 7/1960 | Anderson et al. | 336/5 |
| 3,008,106 | A | * | 11/1961 | Richardson, Jr. | 336/5 |
| 5,168,255 | A | * | 12/1992 | Poulsen | 336/5 |

* cited by examiner

*Primary Examiner* — Alexander Talpalatski
*Assistant Examiner* — Mangtin Lian
(74) *Attorney, Agent, or Firm* — Steven J. Sullivan

(57) ABSTRACT

A high leakage inductance transformer core device, and method of forming same, that has a core made of tape wound material, at least one set of concentric primary and secondary windings, and at least one flux shunt between the primary and secondary windings which is also made of tape wound material. The transformer core and flux shunts are arranged so that the transformer has a low external magnetic field, and substantially no excess core losses due to principal core flux flowing from one part of the core structure to another through the broad surface of the core tape.

20 Claims, 8 Drawing Sheets

HIGH LEAKAGE TRANSFORMERS WITH TAPE WOUND CORES

FIELD OF THE INVENTION

The present invention relates to electromagnetic transformers used in power converters and, more specifically, to transformers with tape wound cores and a high leakage inductance between a primary and a secondary winding.

BACKGROUND OF THE INVENTION

Transformers are used for galvanic isolation between an input and an output, and/or to 'transform' the impedance; i.e., the ratio of voltage to current at a given power level. Such transformers typically consist of at least two coupled windings on a common ferromagnetic core, a nominal "primary" winding to which input power is conventionally applied, and a "secondary" winding which provides the output power.

Transformer Core Materials

Various transformer core materials and configurations are known in the art. These materials include silicon-steel (Si-steel) in laminated or tape wound form, ferrite, and amorphous and nanocrystalline alloys (in tape wound form), with benefits and drawbacks to each of these materials in various applications. The present invention applies to high leakage inductance transformers with tape wound cores.

The distinction between core laminations and tape (also called "ribbon") is largely based on thickness and the method of assembly. Core laminations are relatively thick, typically greater than 0.1 mm, and are stacked or assembled flat. Core tape materials are generally somewhat thinner than 0.1 mm, and are typically wound around a suitable form or mandrel to provide the desired shape.

Tape wound cores may be used in the "as wound" state, but are often cut into two pieces (cut cores) for assembly with windings. "Bars" (or "bricks") may also be cut from sections of a wound core, and core assemblies may be made from some combination of bars and/or cut cores.

Comparison of Ferrite and Nanocrystalline Tape Cores

Ferrite is a well-known transformer core material and has been one of the principal core materials of choice for frequencies above about 5 to 10 kHz due to low hysteressis and eddy current losses. Although amorphous cores have a somewhat higher saturation flux density, modern nanocrystalline materials have lower hysteressis losses, lower than ferrites up to about 200 kHz and can still operate with 1.6 times the ac flux at 40 kHz and twice the ac flux at 20 kHz for the same loss (based on published data). Furthermore, the nanocrystalline material's saturation flux density $B_{SAT}$ is about 3 times that of ferrites at elevated temperatures of 80-100 degrees C. (1.2 Tesla v. 400 mT). Other tape wound materials with superior properties may yet be developed.

A drawback to nanocrystalline (and other tape wound and laminated core) materials is that the losses are low only when flux flows along the direction of the tape surface; any significant flux which flows normal to the tape surface (e.g., between tape layers, or into the external broad surface of the tape) creates large eddy current losses in the core. Ferrite, on the other hand, has the advantage of being an isotropic ceramic material, allowing flux to flow in any direction in the core without excess losses. (Various "distributed gap" core materials, such as powdered iron, also have the isotropic advantages of ferrite, but their permeabilities are generally too low for most transformer applications.)

Transformer Leakage Inductance

All transformers have a finite leakage inductance between windings, which is due to the energy in the magnetic flux produced by a primary winding which is not coupled to a secondary winding. One manifestation of leakage inductance is that, if the secondary winding is "shorted out", a finite inductance is still seen at the primary winding. In effect, the leakage inductance of a transformer is electrically equivalent to placing inductors in series with one or both of the transformer windings.

The relative magnitude of the leakage inductance of a transformer can be defined as the ratio of reactive power circulating in the leakage inductance divided by the output power, at the full rated output power of the transformer. This relative leakage impedance can also be expressed as $X_L/R$, where $X_L$ is the impedance of the leakage inductance, and R is the secondary load impedance, both viewed from the same winding. For most transformers this ratio is on the order of 2% to 10%, and is often considered a non-ideal and undesirable characteristic.

In other applications, however, the leakage inductance can be of considerable benefit. In power distribution transformers, it will limit the current under fault conditions, such as downed and shorted power lines. If the leakage impedance is 4%, for example, the fault current is limited to 25 times (1/0.04) the full rated load current, which limits the current that fuses or circuit breakers must interrupt. High leakage transformers are also used to limit or control output current in arc welders and gas tube illumination transformers.

In electronic power converters, a high leakage inductance may also be useful. In various "resonant" converters, the leakage inductance can form all or part of a resonant inductance in a circuit. Leakage inductance can also be used to aid in "soft switching" of converters, where energy stored in leakage inductance is used, for example, to bring the transistor voltage to zero before turn-on after another transistor turns off.

High Leakage Inductance Transformers

In many of these applications, however, the practical leakage inductance obtainable with conventional transformer designs is often less than that desired. Referring to FIG. 1, the prior art transformer 10 has ferromagnetic core 11, with primary 12 and secondary 13 wound on the center leg of an E-E or E-I core (so called from the shape of the core pieces or segments). In this construction, the maximum practical leakage impedance may be on the order of 5% to 10%, whereas a leakage impedance of 50% to 100% or more may be required.

Another prior art transformer construction is shown in FIG. 2, where transformer 20 comprises primary and secondary windings 22 and 23 respectively, placed on the outer legs of a so called U-U or C-C core. This construction has several benefits, including more winding cooling area and lower high frequency losses, but the leakage impedance is about half of that of FIG. 1.

A prior art transformer construction with higher leakage inductance is shown in FIG. 3, where transformer 30 has primary 32 and secondary 33 wound side-by-side on core 31. This construction may double or triple the leakage impedance over that of transformer 10 in FIG. 1, but this is still inadequate for many high leakage applications.

A prior art construction with relatively high leakage inductance is shown in FIG. 4, where transformer 40 has primary and secondary windings 42 and 43 placed on opposite legs of core 41. The leakage inductance may be further increased with the construction of FIG. 5. This construction is similar to FIG. 4, with the primary and secondary windings 52 and 53 placed on the outer legs of core 51. In this case, a "flux shunt" 54 with air gap 55 is added between windings 52 and 53, which allows leakage impedances to be three to 10 times higher than even that of FIG. 4.

The transformers of FIGS. 4 and 5 do have a major drawback in generating a large external magnetic "leakage" field, however, as illustrated in FIG. 6. Here transformer 60 again has primary and secondary windings 62 and 63 on outside legs of core 61. This is easily seen if secondary 63 is shorted out. The voltage on a winding is proportional to the rate of change of internal magnetic flux, so a shorted winding, which has essentially zero voltage, must have essentially zero ac flux in the core beneath the winding. The shorted winding 63 thus "blocks" the core flux from the leg under winding 63. This in a sense removes the winding and that part of the core from the magnetic structure, so they are shown in phantom lines in FIG. 6, and the core beneath shorted winding 63 becomes effectively a core air gap 65. The magnetic flux produced by current in primary 62 must form a closed path, so the return flux forms a large external dipole magnetic field, illustrated by flux lines 69 (a similar field develops with the transformer of FIG. 5). Secondary winding 63 need not be shorted out for this external field to develop; any load current flowing in winding 63 will cause an external field 69 proportional to the secondary current. Such external fields can cause severe electromagnetic interference (EMI) problems in higher frequency power converters, and is to be avoided.

A prior art high leakage transformer construction with reduced external field is shown in FIG. 7, where transformer 70 has primary and secondary windings 72 and 73 side-by-side, as in FIG. 3, but now flux shunts 74 are placed between the windings with air gaps 75 on each end of the flux shunts. This construction is very popular in many line frequency (50 Hz and 60 Hz) applications, including ferroresonant transformers. Drawbacks are a somewhat limited winding surface area for cooling, and higher eddy current (so called "skin and proximity effect") losses in high frequency (HF) transformers.

An improved prior art construction is shown in FIGS. 8A and 8B. In this figure, and in FIGS. 9A and 9B, and FIGS. 11A-11B through FIGS. 21A-21B, the "A" figure is a perspective view of the transformer core and flux shunts, without the windings for clarity. The "B" figures show the location of the primary and secondary windings in a cross section through the core.

The transformer 80 of FIG. 8 is similar to that of FIG. 1, but now flux shunts 84, with air gaps 85, are placed between primary winding 82 and secondary 83. This construction increases the winding cooling area and decreases HF eddy current losses, with less of an external field that the transformer of FIG. 7.

Prior art high leakage transformers have traditionally been constructed with either laminated cores (where the orientation of the laminations is shown as 56 in FIGS. 5, and 76 in FIG. 7) or isotropic materials such as ferrite which have no "orientation", as illustrated in FIGS. 4 and 8. These constructions cannot be directly applied to tape wound cores, where the "as wound" orientation of the tape is at right angles to that of laminations. The problem this creates is illustrated in FIG. 9, where an attempt is made to realize the transformer of FIG. 8 with a tape wound core. Here transformer 90 has a conventional tape wound core 91, with additional flux shunts 94 (and air gaps 95) cut as "bars" or "bricks" from a tape wound core. Primary 92 and secondary 93 are arranged as in FIG. 8. Magnetic flux in the flux shunts 94 now flows into transformer core 91 where they join at 98. This flux is normal to the surface of the tape in core 91, and causes large eddy current losses in core 91 at those points.

Thus high leakage transformers with tape wound cores are desired which meet two objectives: a low magnetic field external to the transformer, and principal core flux which flows from one core segment to another along the direction of the tape; i.e., principal core flux does not flow normal to the tape surface.

One potential or seeming prior art approach to meeting the second objective is shown in FIG. 10, redrawn from [2]. This core is said to be made from " . . . rectangular shapes of amorphous metal cores . . . ", but windings are not shown, nor is a function for the core stated. It might be that the core is intended for high leakage transformers, as it resembles the core shown in FIG. 5, with transformer core 101 and possible flux shunt 104, with the air gap 105 shown at one end of the flux shunt. However, this construction would still exhibit the same large external field as that of FIG. 5.

SUMMARY OF THE INVENTION

Accordingly, it is an object of the present invention to provide high leakage inductance transformers with tape wound cores, in which the principal flux in all parts of the core flows predominantly in directions parallel to the broad surface of the core tape.

It is another object of the present invention to develop high leakage transformers with minimal external magnetic field.

These objectives are accomplished by meeting three principle criteria:

1) Primary and secondary windings are "concentric" (as defined below);
2) At least one flux shunt is placed between the primary and secondary windings, with the principal flux in the flux shunt returning though the transformer core;
3) Principal core flux flows from one core segment to another through tape edges, and not through the broad surface of the tape.

It is also desirable, but not essential to the invention, that air gaps in the flux shunt paths be relatively uniformly distributed to minimize fringe field losses in the windings. This can be realized as a single air gap near the center of the flux shunt(s), as in FIGS. 11A and 13A, or with similar gaps at the ends of the flux shunt(s) as in FIGS. 14A, 17A and 18A, or multiple air gaps distributed along the flux shunt(s) as in FIG. 12A, where five air gaps are placed in each flux shunt.

These and related objects of the present invention are achieved by use of a high leakage transformer with tape wound core as described herein.

The attainment of the foregoing and related advantages and features of the invention should be more readily apparent to those skilled in the art, after review of the following more detailed description of the invention taken together with the drawings.

DETAILED DESCRIPTION

Definitions

1) A transformer core is a ferromagnetic material which carries the majority of the magnetic flux generated by currents in a primary winding.
2) A "flux shunt" is a ferromagnetic core placed between a primary and secondary winding to increase leakage inductance between the two windings. Magnetic flux in the flux shunt has a return path through part of the transformer core.
3) An "air gap" in a core is understood to be a non-magnetic portion of the core, which contains most of the core flux, and which may consist partially or wholly of material other than air.
4) A "winding set" consists of at least one concentric primary and secondary winding pair. The usage of the terms "primary" and "secondary" herein are conventional, in that the primary need not be the "first" or innermost winding.
5) "Concentric" windings have the central axis of one winding located inside another winding. The two windings may or may not have the same central axis.
6) The "broad surface" of a tape or lamination is the surface with the greater dimensions.
7) The "principal flux" in a core is that magnetic flux flowing from one part of the core to another, which is not contained in a fringe field near an air gap in the core, nor in stray fields outside the core.
8) A "core segment" is one of various ferromagnetic pieces which may be used to assemble a transformer core, which may include flux shunts.

Figure 11A:
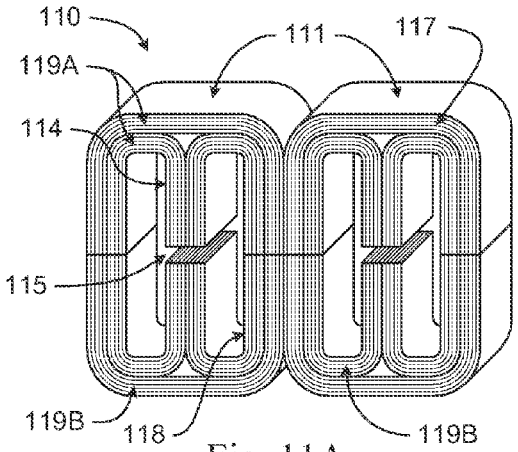
FIGS. 11A-11B is an embodiment of the present invention showing how conventional tape wound cores may be used with a single winding set in a high leakage inductance transformer.
Figure 11B:
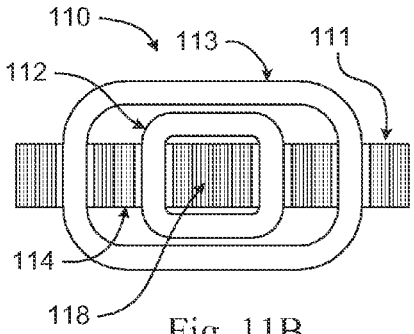

In one embodiment tape wound cores are assembled as shown in FIGS. 11A-11B, including transformer core 111, flux shunts 114 with air gaps 115, primary winding 112 and secondary winding 113. The orientation 117 of the tape is shown, although the thickness of the tape is not shown to scale.

Figure 12A:
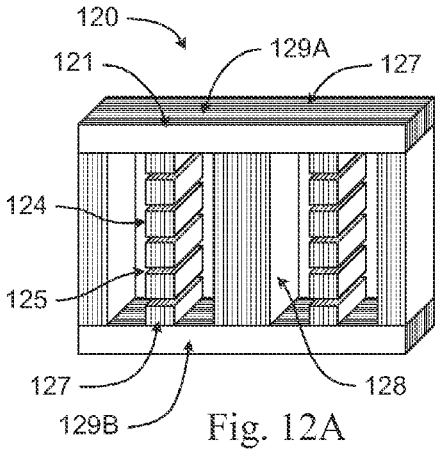
FIGS. 12A-12B is another embodiment of the present invention showing how bars of tape wound cores may be used with a single winding set in a high leakage inductance transformer.
Figure 12B:
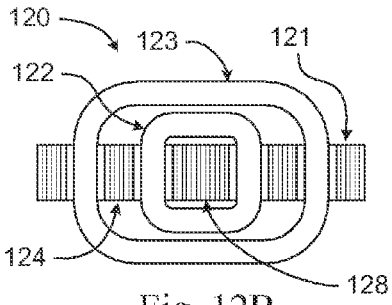

The core 111 may include leg 118 that is coupled to other core segments 119 (that may be termed "bars" in, for example, FIGS. 12, 15 and 16). The embodiments of FIGS. 11A-11B and 12A-12B have a top core segment 119A,129A, respectively, and a bottom core segment 119B,129B, respectively, though top and bottom are arbitrary designations as the core device 110,120 may be otherwise positioned. As shown in FIG. 11A, leg 118 is coupled to top core segments 119A and bottom core segment 119B (ie, to the remainder of the core) through continuous tape layers.

In FIGS. 11A-11B and subsequent figures, all cores are made from tape wound material. One viable orientation of the core tape is shown for illustration; in some cases the tape orientation in core bars may be at right angles to that shown, as long as criteria (3) above is met.

Also in FIGS. 11A-11B and subsequent figures, a final reference number digit "0" refers to a complete transformer, consisting of a core and one or more winding sets, while a final digit "1" refers to a complete core only, without windings. Use of other reference number final digits is intended to be consistent (ie, referencing the same or similar component, respectively) within these remaining figures.

Figure 8A:
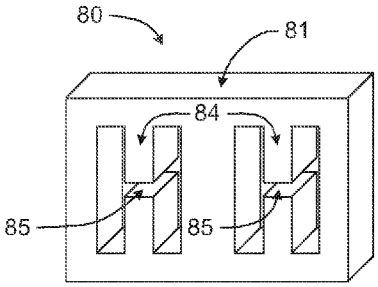
Fig. 8A Prior Art
FIGS. 8A-8B is an illustration of the core and winding arrangement of a prior art high leakage transformer without a significant external magnetic field.
Figure 8B:
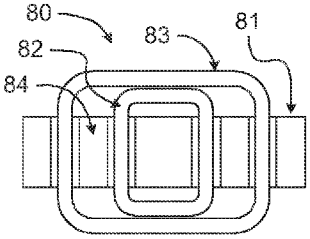
Fig. 8B Prior Art
Figure 9A:
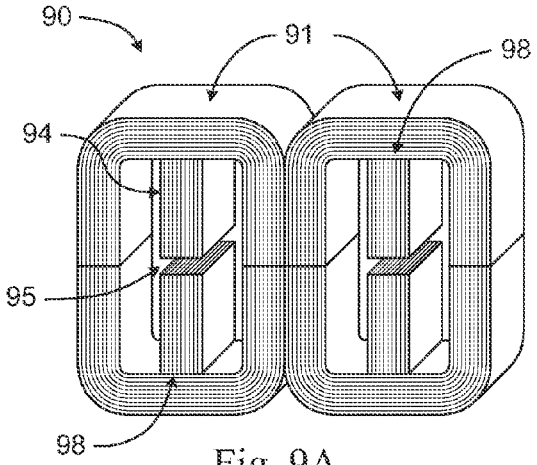
FIGS. 9A-9B is an illustration of a hypothetical tape wound core based on the construction of FIG. 8, with high eddy current losses in the core as flux flows from the flux shunts into the transformer core.
Figure 10:
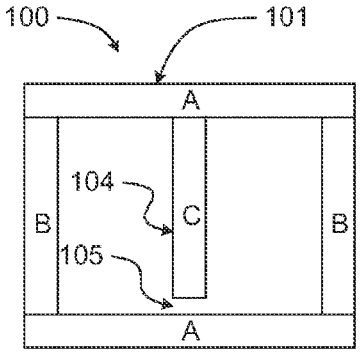
Fig. 10 Prior Art
FIG. 10 is prior art tape wound core construction which may be used in a high leakage inductance transformer.
Figure 9B:
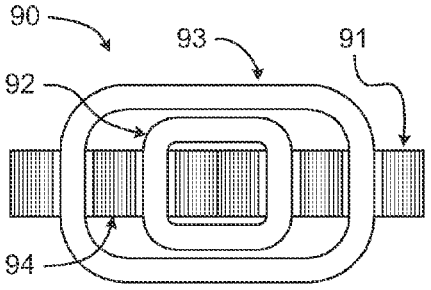

Another preferred embodiment is shown in FIGS. 12A-12B, where core 121 and flux shunts 124 of transformer 120 are made from bars cut from wound tape. The basic geometry is similar to that of FIGS. 8A-8B, with a single winding set consisting of primary 122 and secondary 123. Here multiple distributed air gaps 125 in flux shunts 124 are illustrated. Leg 128 is coupled between top and bottom core segments 129A,129B, respectively. Core segments 129A, 129B are cut "bars" in contrast to the continuous tape layer embodiment of FIG. 11A (and other figures). FIG. 12A (and FIGS. 15A and 16A) illustrate that leg 128 may be coupled into the remainder of the core with a first edge surface of leg 128 abutting an edge surface of the top core segment 129A and a second edge surface of leg 128 abutting the bottom core segment 129B. Primary winding 122 encircles leg 128 while secondary winding 123 encircles the shunts 124 and primary winding 122.

In the figures that follow, the "A" and "B" have been left off the designation of the top and bottom core segments, though it is to be understood (by analogy) that that this designation is implied.

Figure 13A:
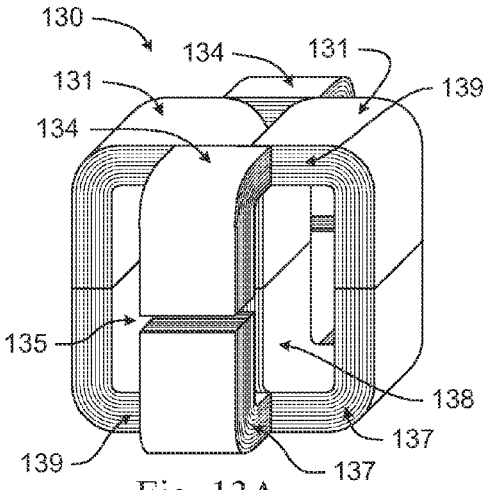
FIGS. 13A-13B is another embodiment of the present invention showing how conventional tape wound cores may be cut and used with a single winding set in a high leakage inductance transformer.
Figure 13B:
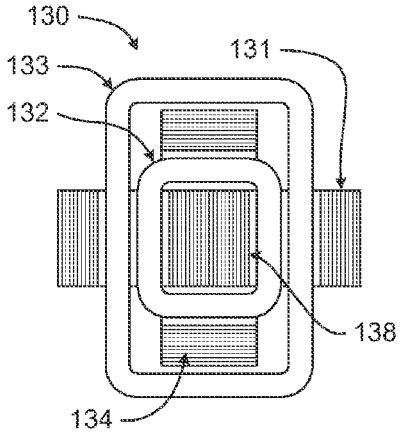

Referring to FIG. 13A, another preferred embodiment is shown with "outrigger" flux shunts 134 that are configured to define air gaps 135 and are cut from tape wound cores similar to the transformer core 131. Primary 132 and secondary windings 133 are placed on the core structure as shown in FIG. 13B.

Leg 138 is coupled to top and bottom core segments 139 through continuous tape layers, and primary winding 132 encircles leg 138. An edge surface of the shunts 134 is preferably coupled to the edge surface of the core 131 tape wound layers. The secondary winding 133 encircles the shunts 134.

Figure 14A:
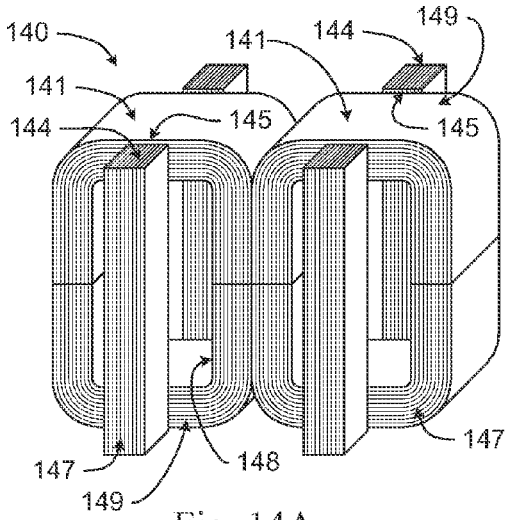
FIGS. 14A-14B is another embodiment of the present invention showing how "outrigger" flux shunts may be used with conventional tape wound cores and a single winding set in a high leakage inductance transformer.
Figure 14B:
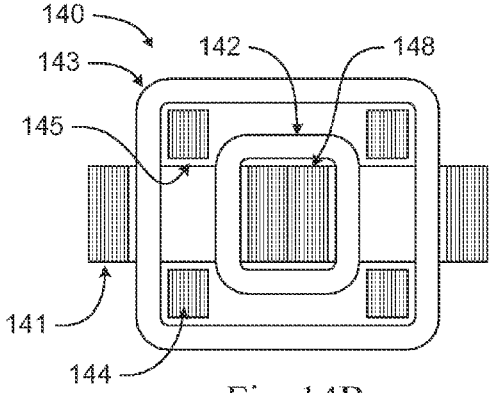

In FIG. 14A, another preferred embodiment is illustrated where outrigger flux shunts 144 are made from bars and placed as shown, with air gaps 145 at each end of each flux shunt. Primary 142 and secondary 143 are placed on the core structure as shown in FIG. 14B.

Leg 148 is coupled to top and bottom core segments 149 via continuous tape layers and is encircled by primary winding 142. While spaced by a gap, the edge surface of the shunts preferably face an edge surface of the core.

Figure 15A:
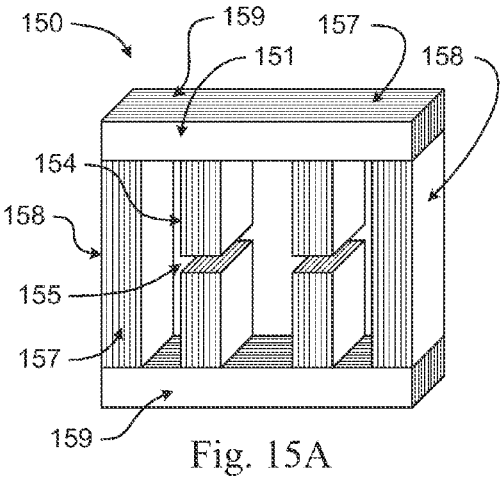
FIGS. 15A-15B is another embodiment of the present invention showing how bars of tape wound cores may be used with a dual winding set in a high leakage inductance transformer.
Figure 15B:
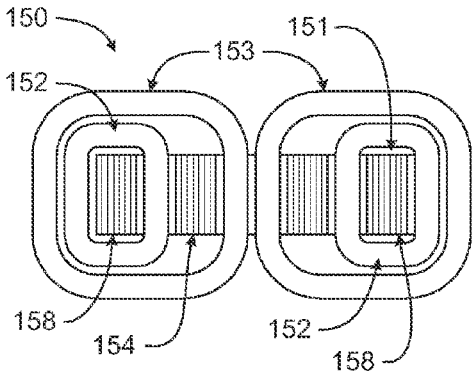

In FIGS. 15A-15B, another preferred embodiment is shown. Transformer 150 has a dual set of windings 152, 153 that are placed on transformer core 151 with flux shunts 154 (with central air gaps 155), all made with tape core bars. Two legs 158 are coupled between the top and bottom core bar segments 159 through their respective edge surfaces. A primary winding 152 encircles each of the legs 158, and a secondary winding 153 encircles a primary winding and shunt.

Figure 16A:
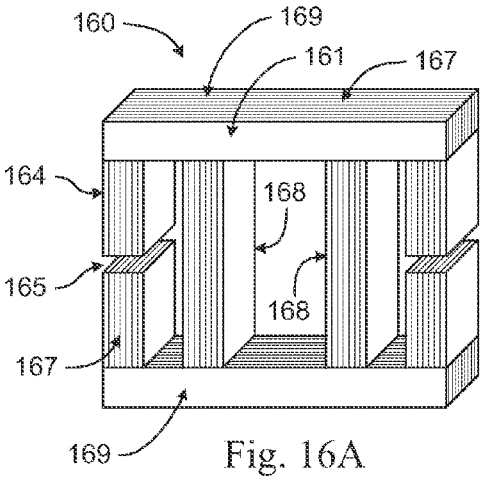
FIGS. 16A-16B is an alternative embodiment of the present invention showing how bars of tape wound cores may be used with a dual winding set in a high leakage inductance transformer, wherein the flux shunts have been moved to the outside of the core.
Figure 16B:
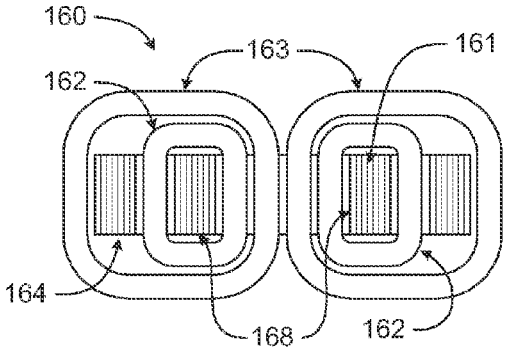

In FIGS. 16A-16B, a similar preferred embodiment to that of FIGS. 15A-15B is shown, with flux shunts 164 of transformer 160 moved to the outside of the core, and with dual primaries 162 and secondaries 163 placed as shown on the core structure. The dual primaries 162 respectively encircle legs 168 which are connected between the top and bottom bar segments 169.

Figure 17A:
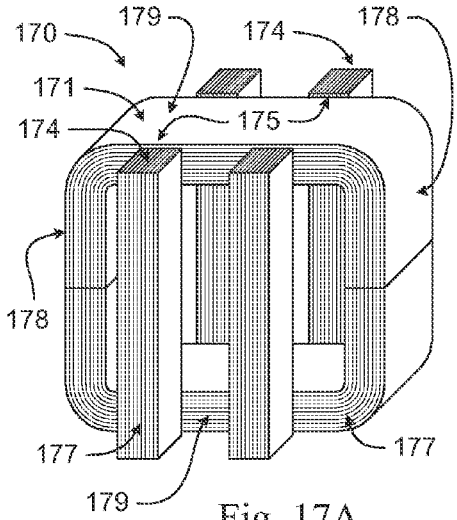
FIGS. 17A-17B is another embodiment of the present invention showing how "outrigger" flux shunts may be used with a conventional tape wound core and a dual winding set in a high leakage inductance transformer.
Figure 17B:
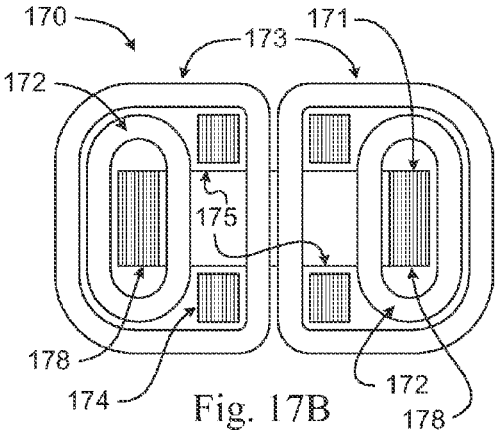

In the preferred embodiment of FIGS. 17A-17B, a transformer 170 is shown with transformer core 171 and outrigger flux shunts 174 made from tape core bars, with air gaps 175 at each end of the flux shunts. Dual primaries 172 and secondaries 173 are placed on the core structure as shown. Legs 178 may be coupled between top and bottom core segments 179 via continuous layers of tape material. While spaced by a gap, an edge surface of the flux shunts 174 preferably faces an edge surface of the core 171. FIG. 17A clearly shows the orientation 177 of the tape layers.

Figure 18A:
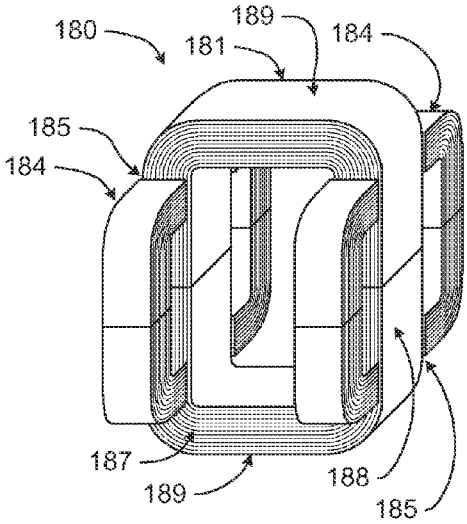
FIGS. 18A-18B is another embodiment of the present invention showing how "outrigger" flux shunts may be cut from, and used with, a conventional tape wound core and a dual winding set in a high leakage inductance transformer.
Figure 18B:
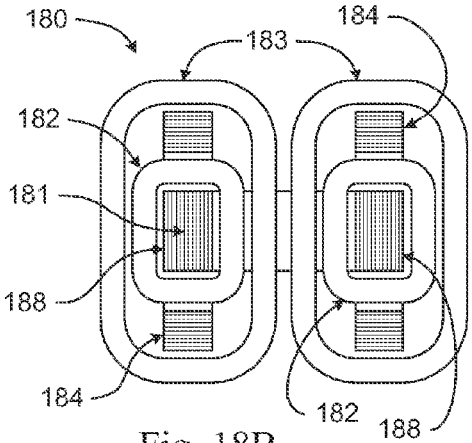

In the preferred embodiment of FIGS. 18A-18B, a transformer 180 is shown with transformer core 181 and outrigger flux shunts 184 made from wound tape cores, with air gaps 185 at each end of the flux shunts. Dual primaries 182 and secondaries 183 are preferably placed on the core structure as shown. Legs 188 are preferably coupled between top and bottom core segments 179 via continuous layers of tape material. While spaced by a gap 185, an edge surface of the flux shunts 184 preferably faces an edge surface of the core 181. Reference numeral 187 designates the orientation of the tape wound layers in the core, and indicates an edge surface of core 181 in FIG. 18A.

Figure 1:
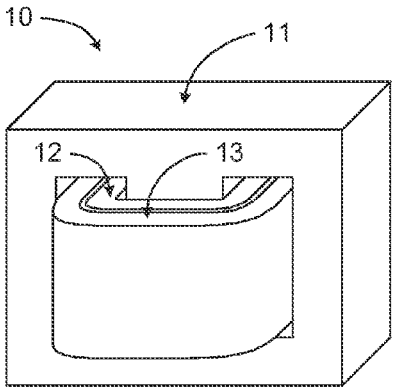
Fig. 1 Prior Art
FIG. 1 is an illustration of a prior art transformer construction, with a single winding set on the center leg of a three leg core.
Figure 2:
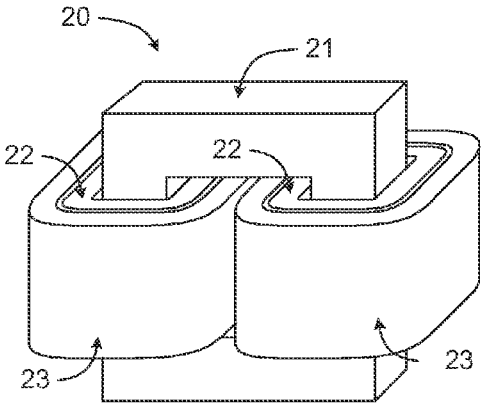
Fig. 2 Prior Art
FIG. 2 is an illustration of a prior art transformer construction, with a dual winding set on the opposite legs of a two leg core.
Figure 3:
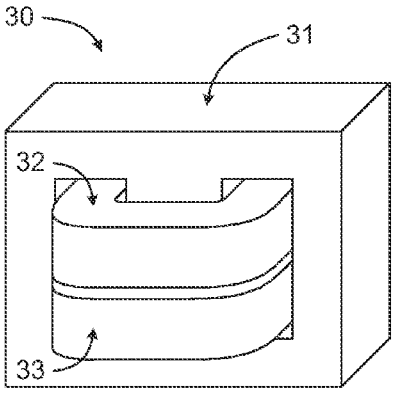
Fig. 3 Prior Art
FIG. 3 is an illustration of a prior art higher leakage transformer construction, with a primary and a secondary winding placed side-by-side on the center leg of a three leg core.
Figure 4:
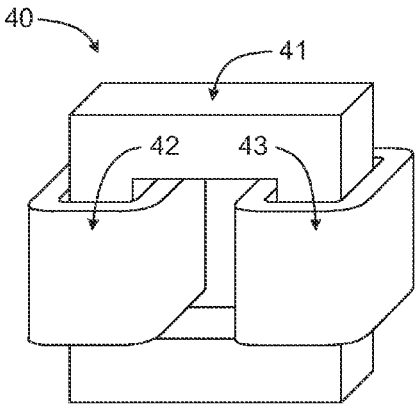
Fig. 4 Prior Art
FIG. 4 is an illustration of a prior art high leakage transformer construction, with a primary and secondary windings placed separately on the opposite legs of a two leg core.
Figure 5:
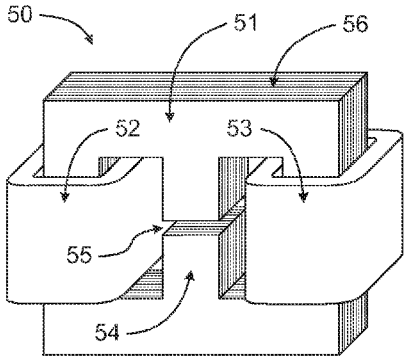
Fig. 5 Prior Art
FIG. 5 is an illustration of a prior art high leakage transformer construction, with primary and secondary windings placed separately on the outer legs of a three leg core, where the third leg between the two windings forms a flux shunt to increase the leakage inductance.
Figure 6:
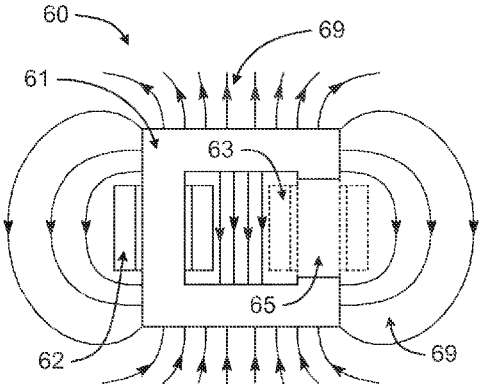
Fig. 6 Prior Art
FIG. 6 is an illustration of the external magnetic field which occurs when a current flows in the secondary of the high leakage transformer of FIG. 4
Figure 7:
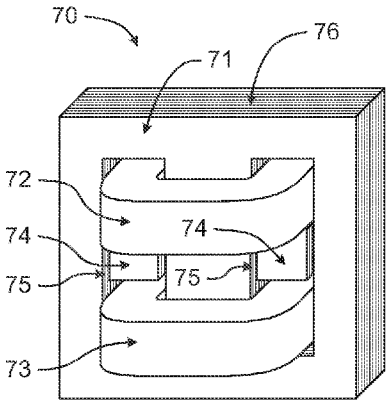
Fig. 7 Prior Art
FIG. 7 is an illustration of a prior art high leakage transformer construction, with a primary and a secondary winding placed side-by-side on the center leg of a three leg core, with flux shunts between the windings to increase the leakage inductance.

The term "planar transformer" applies to transformers with planar windings; i.e., winding layers are in a plane instead of forming a cylinder or solenoid. They basically have the geometry of FIG. 3, but usually with a height somewhat less than the width or depth.

Figure 19A:
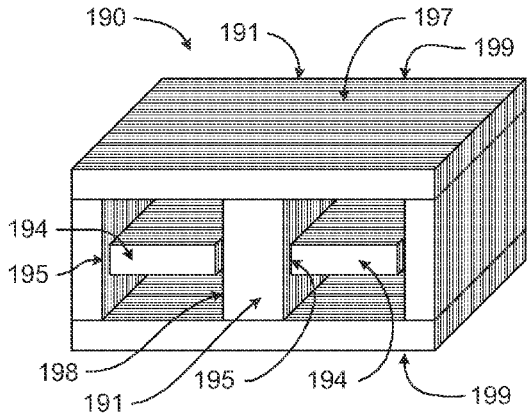
FIGS. 19A-19B is another embodiment of the present invention showing how bars of tape wound core may be used in a high leakage inductance planar winding transformer.
Figure 19B:
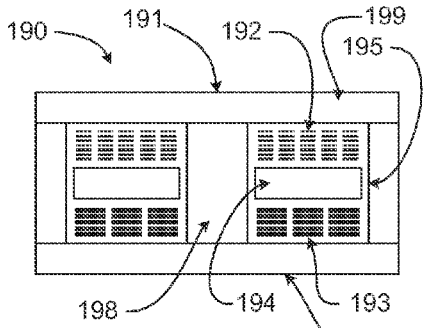

One preferred embodiment of a planar transformer according to this invention is designated by reference numeral 190 in FIGS. 19A-19B. The transformer core 191 and flux shunts 194 are preferably made from tape core bars. The flux shunts are placed between the planar transformer winding 192 and planar secondary winding 193, with the orientation of the winding layers illustrated in FIG. 19B. Core 191 may include a leg 198 that is coupled between core bar segments 199 in a manner similar to that discussed above for FIGS. 12A-12B. Primary winding 192 encircles leg 198, while secondary winding 193 is concentric as defined herein with the primary winding.

Figure 20A:
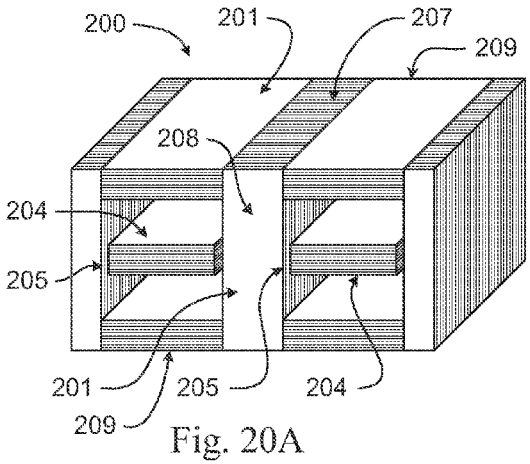
FIGS. 20A-20B is another embodiment of the present invention showing how bars of tape wound core may be used in alternative orientations in a high leakage inductance planar winding transformer.
Figure 20B:
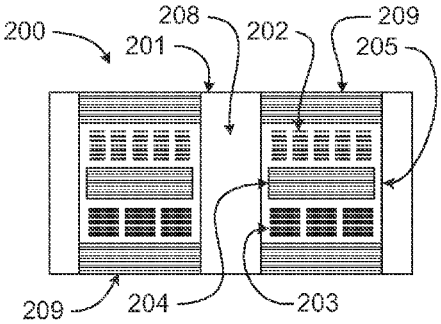

Another preferred embodiment of a planar transformer 200 is shown in FIG. 20. The construction is similar to that of FIG. 19, but with an alternative tape orientation.

Figure 21A:
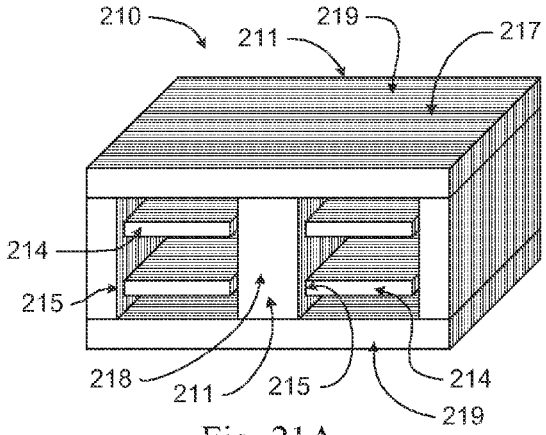
FIGS. 21A-21B is another embodiment of the present invention showing how bars of tape wound core may be used in a high leakage inductance planar winding transformer, wherein interleaved windings are used.
Figure 21B:
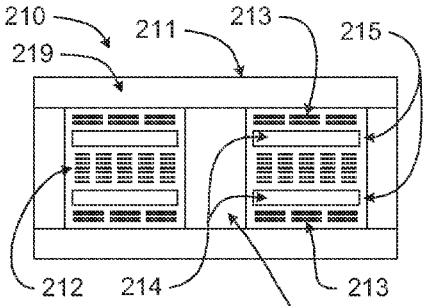

In all cases it is possible to have an "interleaved" winding consisting of more than one primary and/or secondary, with suitable flux shunts between windings. Common arrangements are to split a primary winding into two halves "sandwiching" the secondary, or visa versa, and more complex arrangements are possible. An example is shown in FIG. 21 for planar transformer 210, with two sets of flux shunts 214 (with air gaps 215) between the split secondary 213 and the sandwiched primary 212.

Core 211 may include a leg 218 that is coupled between top and bottom core bar segments 219 in a manner similar to that discussed above. Primary winding 212 encircles leg 218, while secondary winding 213 is concentric as defined herein with the primary winding.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features herein before set forth, and as fall within the scope of the invention and the limits of the appended claims.

REFERENCES

[1] Extract from "Design Considerations for High Frequency Linear Magnetics", B. Carsten, Seminar presented at the PCIM Conference in Nurnberg, Germany, May 21, 2007, May 12, 2009, and other venues.

[2] Hill Technical Sales Corp. brochure, available at: www.hilltech.com/products/emc components/Amorphous Shie lding.html

[3] J. Biela, J. W. Kolar, "Electromagnetic Integration of High Power Resonant circuits Comprising High Leakage Inductance Transformers", Power Electronic Systems Laboratory, ETH Zurich, Zurich, Switzerland

[4] A. E. Feinberg, U.S. Pat. No. 3,392,310: "High Leakage Transformer and Gaseous Discharge Lamp Circuit Regulated by such Transformer", Jul. 9, 1968.

[5] Sayed-Amr El-Hamamsy, U.S. Pat. No. 4,902,942: "Controlled Leakage Transformer for Fluorescent Lamp Ballast Including Integral Ballasting Inductor", Feb. 20, 1990

[6] Raets et al., U.S. Pat. No. 6,100,781: "High Leakage inductance Transformer", Aug. 8, 2000

[7] Chi-Chip WU, US patent application US2010/0134230 A1, "Transformer with High Leakage Inductance" Jun. 3, 2010

The invention claimed is:

1. A tape wound core device, comprising:

tape wound material arranged as a core, the tape wound material formed of an accumulation of tape wound layers that in aggregate have a broad surface and edge surfaces, wherein the core includes a first core leg formed of the tape wound material that has a first leg broad surface and first leg edge surfaces;

a primary winding;

a secondary winding that is concentric with the primary winding, at least one of the primary and secondary windings encircling the first core leg;

a first flux shunt of tape wound material positioned between the first and second windings;

wherein the first leg is coupled into the core other than with an edge surface of the first leg abutting a broad surface of a tape wound layer of the core; and wherein the first flux shunt has a broad surface and edge surfaces and is coupled into the core other than with an edge surface of the first flux shunt abutting a broad surface of one of the tape wound layers of the core.

2. The core device of claim 1, wherein the core further includes:

a first core segment formed of the tape wound layers and having a broad surface and an edge surface;

a second core segment, formed of the tape wound layers and having a broad surface and an edge surface, that is spaced from the first core segment;

wherein one edge surface of the first leg is coupled for the edge surface of the first core segment.

3. The device of claim 2, wherein another edge surface of the first leg is coupled to the edge surface of the second core segment.

4. The core device of claim 1, wherein the core further includes:

a first core segment formed of the tape wound layers and having a broad surface and an edge surface;

a second core segment, formed of the tape wound layers and having a broad surface and an edge surface, that is spaced from the first core segment;

wherein the first core segment and first leg are configured such that at least some of the tape wound layers in the first leg are continuous with tape wound layers in the first core segment.

5. The core device of claim 4, wherein the second core segment and first leg are configured such that at least some of the tape wound layers in the first leg are continuous with tape wound layers in the second core segment.

6. The core device of claim 1, wherein the first leg is arranged in a non-parallel arrangement with the first or second core segment.

7. The core device of claim 1, wherein the core further includes:

a first core segment formed of the tape wound layers and having a broad surface and an edge surface; and a second core segment, formed of the tape wound layers and having a broad surface and an edge surface, that is spaced from the first core segment;

wherein the first flux shunt has a broad surface and edge surfaces and is coupled into the core other than with an edge surface of the first flux shunt abutting a broad surface of one of the tape wound layers of the first or second core segments.

8. The core device of claim 7, wherein the first flux shunt has a first edge surface directly coupled to an edge surface of the first core segment and a second edge surface directly coupled to an edge surface of the second core segment, the first flux shunt further defining a gap therein located along the first flux shunt between the first edge surface and the second edge surface of that first flux shunt.

9. The core device of claim 7, wherein the first flux shunt is separated by a gap from the first core segment, and has a first edge surface that faces, across that gap, an edge surface of the first core segment.

10. The core device of claim 7, wherein the first flux shunt is configured to define a plurality of gaps therein.

11. The core device of claim 1, wherein the primary and secondary windings have a planar core configuration.

12. The core device of claim 1, wherein the tape wound material includes nanocrystalline material.

13. A tape wound core device, comprising:

tape wound material arranged as a core, the tape wound material formed of an accumulation of tape wound layers that in aggregate have a broad surface and edge surfaces, wherein the core includes a first core leg formed of the tape wound layers;

a primary winding;

a secondary winding that is concentric with the primary winding, at least one of the primary and secondary windings encircling the first leg;

a first flux shunt formed of layers of tape wound material positioned between the first and second windings;

wherein the layers of the first leg transition into a remainder of the core by one or more of:

an edge surface of the first leg abuts an edge surface of tape wound layers of the remainder of the core, and tape wound layers of the first leg are continuous, at least in part, with tape wound layers of the remainder of the core; and wherein the first flux shunt is coupled to a remainder of the core by one or more of:

an edge surface of the first flux shunt abuts an edge surface of tape wound layers of the remainder of the core;

tape wound layers of the first flux shunt are continuous, at least in part, with tape wound layers of the remainder of the core; and an edge surface of the first flux shunt is separated by a gap from an edge surface of tape wound layers of the remainder of the core.

14. The core device of claim 13, wherein the core further includes:

a first core segment that is part of said remainder of the core and is formed of tape wound layers and has a broad surface and an edge surface;

a second core segment, spaced from the first core segment, that is part of said remainder of the core and is formed of tape wound layers and has a broad surface and an edge surface;

wherein the edge surface of the first leg is directly coupled to an edge surface of the first core segment.

15. The core device of claim 13, wherein the core further includes:

a first core segment that is part of said remainder of the core and is formed of tape wound layers and has a broad surface and an edge surface;

a second core segment, spaced from the first core segment, that is part of said remainder of the core and is formed of tape wound layers and has a broad surface and an edge surface;

wherein the first core segment and first leg are configured such that at least some of the tape wound layers in the first leg are continuous with tape wound layers in the first core segment.

16. The core device of claim 13, wherein the first flux shunt has a first edge surface directly coupled to an edge surface of said remainder of the core, the first flux shunt further defining a gap therein.

17. The device of claim 13, wherein the tape wound layers of the first flux shunt are continuous, at least in part, with tape wound layers of the remainder of the core.

18. The core device of claim 13, wherein the first flux shunt has a first edge surface and a broad surface, wherein the first edge surface of the first flux shunt is separated by a gap from an edge surface of said remainder of the core.

19. The core device of claim 13, wherein the tape wound material includes nanocrystalline material.

20. A high leakage inductance transformer device, comprising:

a tape wound transformer core formed of an accumulation of tape wound layers, each tape wound layer having a broad surface and an edge surface;

at least one set of concentric primary and secondary windings on the transformer core;

at least one flux shunt formed of tape wound layers that is located between the primary and secondary windings, and arranged so that the principal magnetic flux in the flux shunt flows substantially into the transformer core without passing through the broad surfaces of the core tape wound layers; and further wherein the first flux shunt is coupled to a remainder of the core by one or more of:

an edge surface of the first flux shunt abuts an edge surface of tape wound layers of the remainder of the core;

tape wound layers of the first flux shunt are continuous, at least in part, with tape wound layers of the remainder of the core; and an edge surface of the first flux shunt is separated by a gap from an edge surface of tape wound layers of the remainder of the core.

* * * * *